US005490356A

United States Patent [19]

Kemeny

[11] Patent Number: 5,490,356

[45] Date of Patent: Feb. 13, 1996

[54] SEISMIC ISOLATION BEARING

[75] Inventor: Zoltan A. Kemeny, Tempe, Ariz.

[73] Assignee: MM Systems of Arizona, Phoenix, Ariz.

[21] Appl. No.: 156,550

[22] Filed: Nov. 24, 1993

[51] Int. Cl.[6] ..... E04B 1/98

[52] U.S. Cl. ..... 52/167.7; 52/167.8; 52/167.1; 248/638; 248/632

[58] Field of Search ..... 52/167 EA, 167 R, 52/167 RA, 167 E, 167.1, 167.6, 167.7, 167.8; 248/602, 632, 633, 638; 411/386, 388, 389, 406

[56] References Cited

U.S. PATENT DOCUMENTS

| | | | |
|---|---|---|---|
| 2,660,386 | 11/1953 | Munro | 248/638 |
| 3,245,646 | 4/1966 | Baratoff | 248/632 |
| 3,430,901 | 3/1969 | Cauvin | 248/632 |
| 4,065,082 | 12/1977 | Oota | 248/632 |
| 4,117,637 | 10/1978 | Robinson | 52/167 |
| 4,463,753 | 8/1984 | Gustilo | 411/386 |
| 4,633,628 | 1/1987 | Mostaghel | 52/167 E |
| 4,644,714 | 2/1987 | Zayas | 52/167 |
| 4,713,917 | 12/1987 | Buckle et al. | 52/167 EA |
| 4,727,695 | 3/1988 | Kemeny | 52/167 R |
| 4,744,539 | 5/1988 | Stimeling | 248/632 |
| 4,823,522 | 4/1989 | White | 52/167 |
| 4,887,788 | 12/1989 | Fischer et al. | 248/632 |
| 4,910,930 | 3/1990 | Way | 52/167 R |
| 4,942,703 | 7/1990 | Nicolai | 52/167 E |
| 5,215,382 | 7/1993 | Kemeny | 384/36 |
| 5,242,147 | 9/1993 | Kemeny | 248/638 |
| 5,339,580 | 8/1994 | Koshika et al. | 52/167 EA |

OTHER PUBLICATIONS

See attached, FIP Industriale (Italy Catalog).

*Primary Examiner*—Carl D. Friedman
*Assistant Examiner*—Winnie S. Yip
*Attorney, Agent, or Firm*—Michael K. Kelly; Snell & Wilmer

[57] ABSTRACT

A seismic isolation bearing for bridges, buildings and machines with steel reinforced rubber body and external or internal tapered steel pin uniform yielders. The pins are fixed to load plates and intersect in mid plate or in the bearing body. External pins may be threaded ended to be used with nuts and other hardware as temporary press for assembly. Also as temporary ties for handling before installation or as anchorbolts. Vertical bearing stiffness is greatly controlled by the size of a central hole, passing vertically through the bearing.

20 Claims, 4 Drawing Sheets

SEISMIC ISOLATION BEARING

BACKGROUND OF THE INVENTION

This invention relates to seismic isolation bearings for structures and machines, specifically to rubber bearings having tapered steel pin yielders.

It is common to mount structures and machines on seismic isolation bearings, sometimes referred as base isolators.

Bridges and buildings commonly use rubber bearings reinforced with steel plates. Machines mostly use steel coil springs combined with snubbers. Rubber bearings are made of high damping rubber or else are supplemented with lead or steel yielder for energy dissipation. Known metallic yielders in rubber bearings destroy vertical isolation. The viscous and hysteretic damping portion in a high damping rubber bearing is difficult to separate, yet that is a must for proper design. Steel spring mounts for machines are unable to provide energy dissipation, thus have wide bearing movements, which need to be limited by snubbers. The machine impacting on snubber may receive higher acceleration then from the ground due to seismicity. Snubbers are also used for rubber bearings. For extremely high vertical loads sliding type seismic isolators are also used. However, their friction coefficient can not be maintained constant and they have no vertical isolation and uplift capacity, all needed by design.

U.S. Pat. No. 4,644,714 discloses a friction type isolation bearing, which incorporates rigid snubber.

U.S. Pat. Nos. 4,605,106 and 4,718,206 to Fyfe et al. (1986 and 1988) disclose high damping rubber bearings. In such rubbers the velocity and the displacement related damping components are virtually inseparable, thus their seismic design is difficult.

U.S. Pat. No. 4,117,637 discloses rubber bearings with lead core yielder. The lead is a rigid body across these isolators carrying a high potion of the vertical load and preventing vertical isolation. Saw cut bearings had shown that the lead may be pumped out of its core due to its softness under repeated compression and shear loadings.

Steel is more ductile and a more reliable yielder than lead. Thus several attempt have been made to use steel yielders in rubber bearings. U.S. Pat. Nos. 4,727,695 and 5,215,382 and 5,242,147 to Kemeny (1988, 1993 and 1993, my own patents) are using steel plate or dowel yielders in rubber bearings with little effort to provide uniform volumetric yielding. Due to low cycle fatigue, their local yielding limits the number of consecutive earthquakes the bearings can balance. U.S. Pat. No. 4,910,930 to Way (1990) uses an external coil yielder which yields locally but that locality is shifting during an earthquake. U.S. Pat. No. 4,823,522 to White (1989) discloses uniform yielders but these yield one way only. Therefore are used as supplemental dampers in interstories and not in base isolators. An italian company, named FIP, offers a sliding bearing with uniform yielder, which crosses the bearing vertically. The ballhead at the end of its yielder fixes the lateral force height, which facilitate its design but limits the yielder's displacement. Also imposes unwanted tension on the yielder and result in strength degradation.

Rubber bearings require temporary ties for transportation and handling before installation. Rubber bearings are limited in volume, thus in size. That is due to maximum allowed bach volume and heat absorption capacity of the unvulcanized compound. Yet, today greater bearings are in demand increasingly.

Yielders internal to the rubber bearing are well protected from corrosion, but are uninspectable. External yielders are visually inspectable. Known bearings has either internal or external yielders. Bearings to provide for these two options within the same mechanism are unknown today.

The most frequently used bearing today in the USA contains lead in great quantity. Lead is, however, environmentally hazardous. Bearings are designed to be replaceable. After such a replacement the lead disposition remains to be a problem, thus bearing specifications favor unleaded bearings.

Rubber manufacturing takes place far from populated cities due to gases emitted in the process. Also due to hazardous solvent use. Rubber do not dissolve naturally when disposed. Therefore several rubber product is made of revulcanized, recycled rubber, such as shredded tire flakes. Such rubber helps cleaning the environment and provides jobs in populated cities due to its environmental friendly technology. Strong glues makes it possible today to utilize recycled rubber cold bonded in isolation bearings. Such bearing is much cheaper then a hot vulcanized of the same size and quality.

It is therefore the main object of this invention is to provide a seismic isolation rubber bearing with steel energy dissipators, yielding uniformly in both horizontal way, without interference with vertical isolation.

The other objects of this invention are:

a) to provide displacement limiting capability to rubber bearing utilizing its steel yielders;

b) to provide uniform yielding in the bearing's steel yielders without imposing other than bending in them at any displacement;

c) to provide modular bearing construction allowing to increase bearing sizes to exceed the limits imposed by current rubber technology;

d) to provide elastomeric support to machines with ductile displacement limiters and energy dissipators but without local yielding of the bearing's anchoring element;

e) to provide for the possibility of external and internal yielder placement in the bearing without changing bearing mechanism;

f) to provide unleaded bearing saving our environment;

g) to provide the possibility of using environmental friendly, recycled, cold bonded rubber as well as hot vulcanizing without the need to change bearing system or mechanism;

h) to provide the possibility of bridge, building and machine base isolation without the need to change system or mechanism.

SUMMARY OF THE INVENTION

The invention achieves its objectives by a steel reinforced rubber seismic isolation bearing. Tapered steel pin yielders extend up from the bottom load plate and down from the top load plate. Pins intersect in the holes of a mid plate embodied into the bearing or in holes of the bering body itself. Exposed pins may be threaded at ends to serve with nuts and temporary sleeves and washers as temporary presses. That is for cold bonded rubber laminating and for transportation and handling before bearing installation. The size of a central hole passing vertically through the bearing body serves to modify bearing stiffness. That is to be able to serve as bridge or building isolator. Also as machine base isolator, which need to be vertically soft. The pins slide in the mid plate hole or in the bering body hole. That is for not to impose other than bending in the pin while the bearing deflects in shear. Vertical bearing movement and isolation is not restrained by the pins. The pin's cross section relative to its height from fixity is so designed to provide uniform volumetric yielding of the pin at any bering shear displacement. Such pin's contour appears to be a transitive curve between a straight and a cubic root function taper lines. The uniform yielding provides for high energy dissipation of the pin in many repeated bending cycles exceeding the requirement imposed by repeated earthquakes. The temporary press utilization of the pins provides for cold bonding rubber lamination technique. That allows for the use of environment friendly, cheap, recycled, revulcanized rubber plates. Nuts left locked on the pin ends provide for the possibility of bearing shear displacement limiting and anchorage. The use of steel pins allows for environmentally safe unleaded bearing construction. Doubling the mid plate allows for increasing bering size over the current technology limit.

BRIEF DESCRIPTION OF THE DRAWINGS

The invention may be better understand considering the following drawings in which.

DETAILED DESCRIPTION OF THE INVENTION

Figure 1:
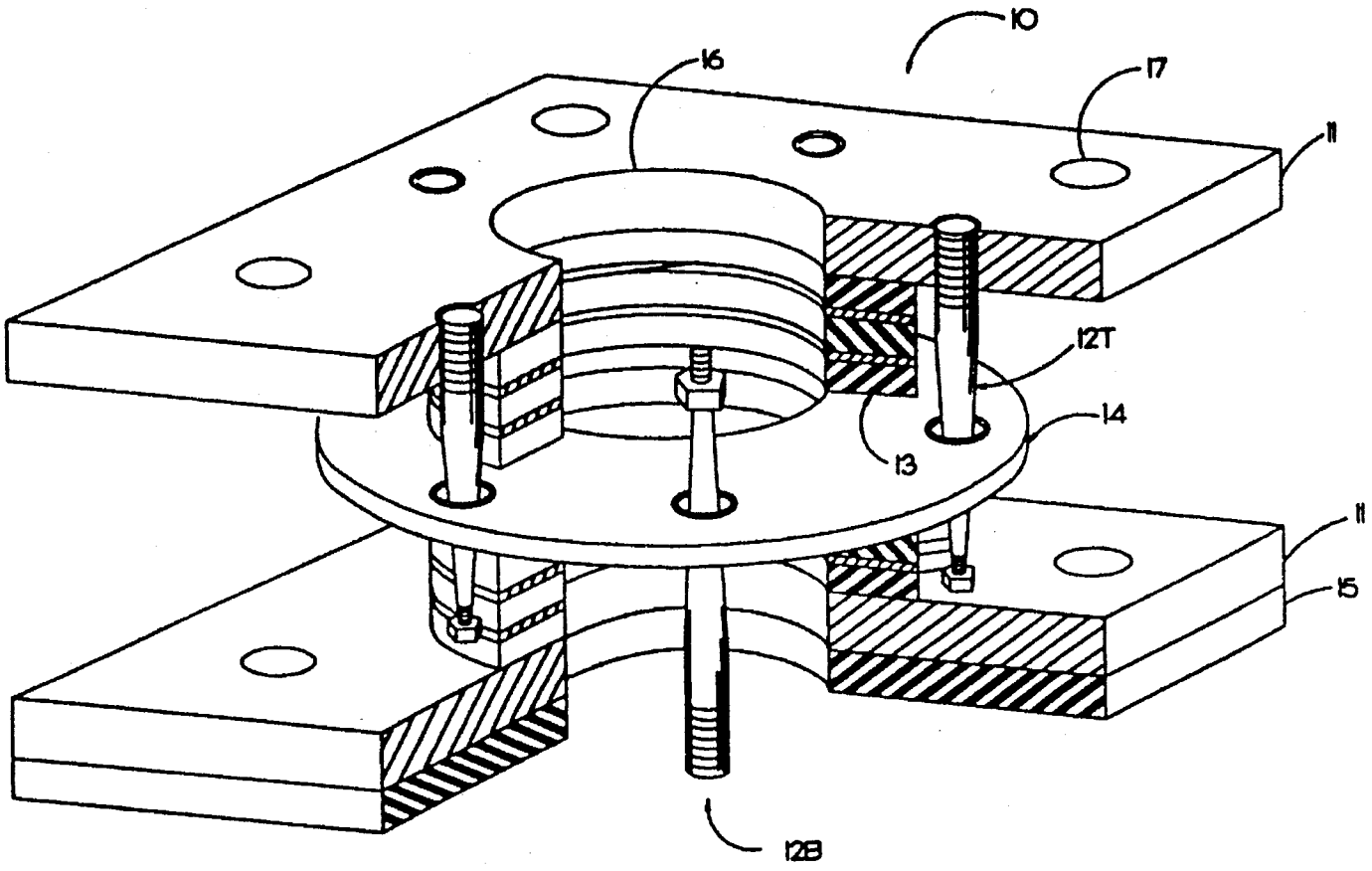
FIG. 1 illustrates an isolation bearing with external pins.

FIG. 1 illustrates a steel-rubber seismic isolation bearing 10 for bridges, buildings and machines. It has steel pin yielders 12T (top) and 12B (bottom) external to bearing body 13 and activated by steel mid plate 14 incorporated into the middle of the body 13. Pins 12 are fixed by welding or gluing into the holes of steel load plates 11 which are bonded to body 13. The number of pins 12T is equal the number of pins 12B. Bearing 10 has a central, vertical through hole. Rubber layer 15 is placed or glued under the bearing 10 when that is needed for easier mounting especially under machines. Body 13 is vertically stiff if hole 16 is small and soft if hole 16 is big relative to the outside diameter of body 13. Hole 16 may have zero diameter when central hole is not needed. Plate 11 and 15 has holes 17 for anchor bolting bearing 10 to the foundation and to the structure or machine, not shown.

Figure 2:
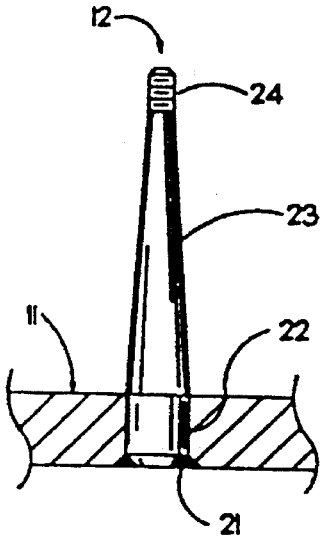
FIG. 2 illustrates a pin.

FIG. 2 illustrates pin 12 fixed to plate 11 by welding 21 or gluing 22. Pin 12 may have threaded end 24 and its taper 23 is linear or cubic root function or other transitional curve between. The taper 23 extends over the mid bearing height. As much that when the bearing is displaced in shear at the allowed extent, the pin 12 still is in engagement with the mid plate.

Figure 3B:
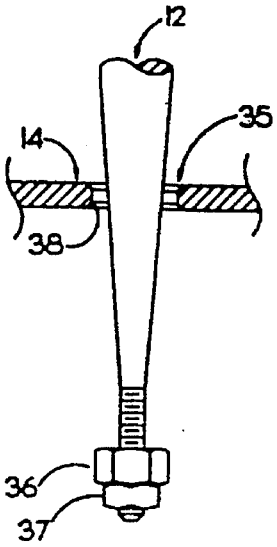
FIG. 3B illustrates the use of pin as displacement limiter or anchorage.
Figure 3A:
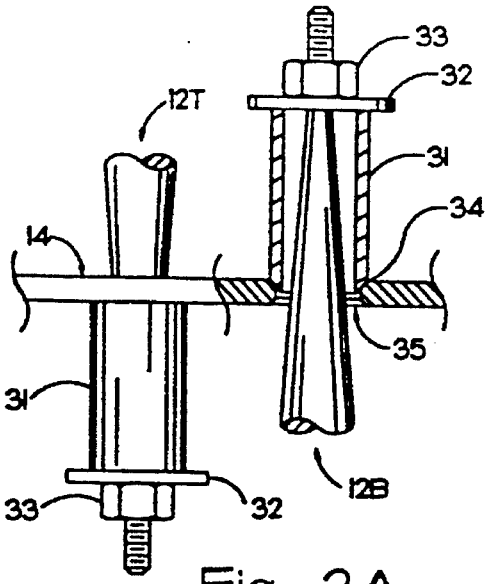
FIG. 3A illustrates the use of pins as temporary press or tie.

FIG. 3A illustrates pin 12T and 12B used as temporary press. That help gluing a cold bonded bearing body. Also as temporary tie to hold the bearing together while handled before installation. A pipe sleeve 31, a washer 32 and a nut 33 helps achieving pressure between the pins 12 and the mid plate 14. Pins 12 pass in a hole 35 bored in plate 14. Hole 35 is bigger in diameter then the pin 12 diameter at hole 35. That leaves a clearance between pin 12 and plate 14. That clearance helps accommodating nonseismic bearing shear. That is due to wind, braking, centrifugal, thermal creep, relaxation and other actions. The end of sleeve 31 is conically chamfered to help centering pin 12 in hole 35 during bearing assembly.

FIG. 3B illustrates pin 12 with counter locked nuts 36 and 37, which helps utilizing pin 12 as bearing displacement limiter or as anchorage. At such limit condition nut 36 locks at plate 14. Chamfer 38 in hole 35 helps avoiding local stress concentrations in pin 12, which is about 45 degree angle to plate 14 at that locking. Pin to mid plate position at locking is not shown for clarity.

Figure 4A:
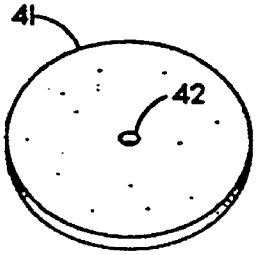
FIG. 4A illustrates a rubber layer in bearings for bridges and buildings having circular plan.

FIG. 4A illustrates a rubber layer 41 in bearings for bridges and buildings. Layer 41 is circular in plan and have a small diameter central hole 42 for passing threaded assembly rod or smooth mold centering pin, not shown. Circular bearings need not to be checked by design for stability for bidirectional horizontal loads.

Figure 4B:
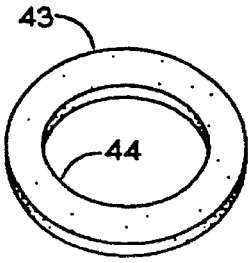
FIG. 4B illustrates a rubber layer in bearings for machines having circular plan.

FIG. 4B illustrates a rubber layer 43 in bearings for machines. Layer 43 is circular in plan and have a big diameter central hole 44. Such rubber ring is as soft vertically as a pitch of a coil spring. Vertical softness is important for machines which vibrate. Machine base isolators need to be vibration isolators as well.

Figure 5A:
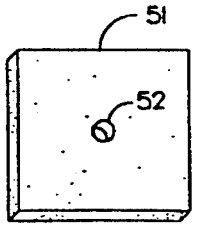
FIG. 5A illustrates a rubber layer in bearings for bridges and buildings having a regular polygonal plan.

FIG. 5A illustrate a rubber layer 51 in bearings for bridges and buildings. Layer 51 has a regular polygon plan shape, which is easy to cut from sheet rubber. Layer 51 may have a small assembly hole 52 in its middle.

Figure 5B:
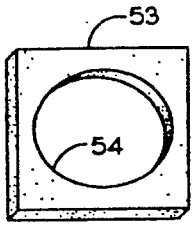
FIG. 5B illustrates a rubber layer in bearings for machines having a regular polygonal plan.

FIG. 5B illustrate a rubber layer 53 in bearings for machines. Layer 53 has a big diameter central hole 54 to provide vertical bearing softness. Such layer is more stabile in shear then the annular ring.

Figure 6A:
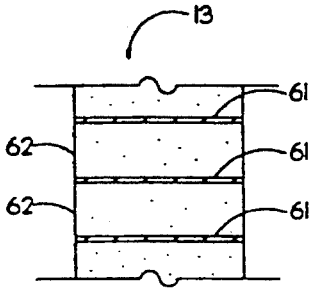
FIG. 6A illustrates bearing lamination with steel shimmings flush to rubber surface.

FIG. 6A illustrates bearing body 13 with steel shims 61 sandwiched in between rubber layers 62. Shims 61 and layers 62 are flush at the vertical walls of body 13. Machines can use exposed shim plates. Such construction is economical.

Figure 6B:
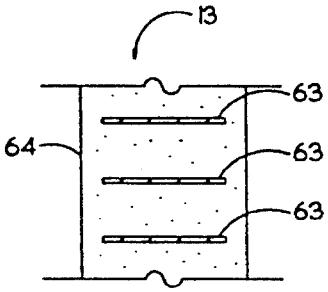
FIG. 6B illustrates bearing lamination with rubber cover on steel shimmings.

FIG. 6B illustrates bearing body 13 with shims 63 embedded in rubber body 64. Shims 63 has rubber cover at sides for corrosion protection. Such bearing construction is required by code today for bridges and buildings.

Figure 6C:
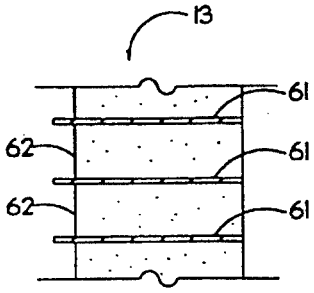
FIG. 6C illustrates bearing lamination with extended steel shimmings.

FIG. 6C illustrates bearing body 13 with steel shims extending from body 13 and sandwiched in between rubber layers Such shim plate extension is used in the outer side of machine base isolators. It provides extra support for stability at wide bearing shear.

Figure 7B:
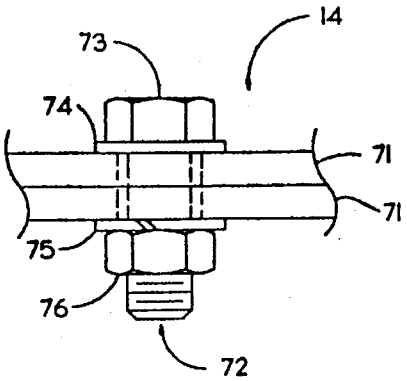
FIG. 7A, 7B and 7C illustrate mid plate doubling to facilitate overcoming current bearing size limitation due to hot vulcanized rubber technology.
Figure 7A:
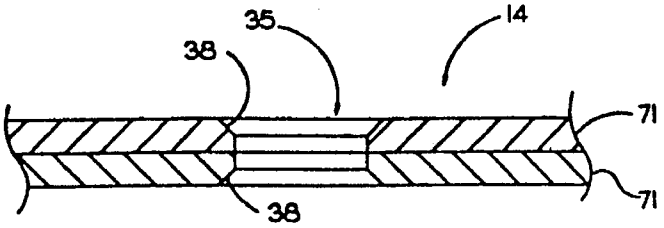

FIG. 7A illustrates a mid plate 14 doubling with holes using plates 71. Such doubling allows for assembling bearings from two parts enabling to overcome current bearing size limitations due to rubber technology. Holes 35 are chamfered 38 the same way as the mid plate would be a single piece, not doubled.

FIG. 7B illustrates a bolted connection of doubled plate 14 with plates 71 and bolting 72 with bolt 73 washers 74 and 75 and with nut 76. Welding doubled plates would prevent dissembling.

Figure 7C:
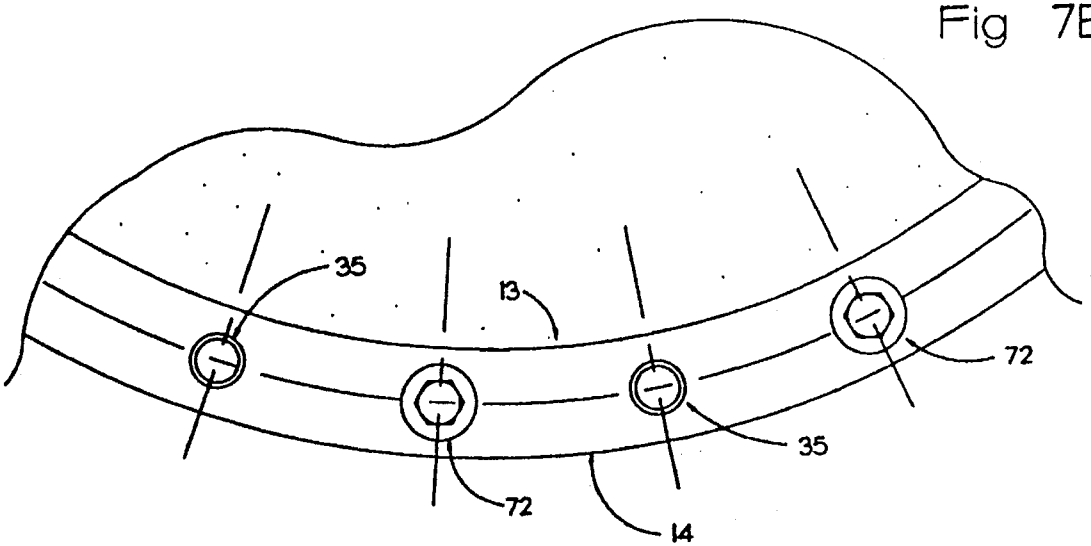

FIG. 7C illustrates a plan arrangement of a doubled mid plate 14 showing the bearing body 13, the holes 35 and the boltings 72.

Figure 8:
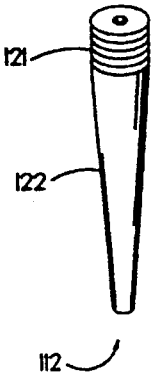
FIG. 8 illustrates a pin for bearings with unexposed yielders.

FIG. 8 illustrates a pin 112 with thread 121 and threadless taper 122 for use in bearings with internal pins. Internal pins are well protected from corrosion.

Figure 9:
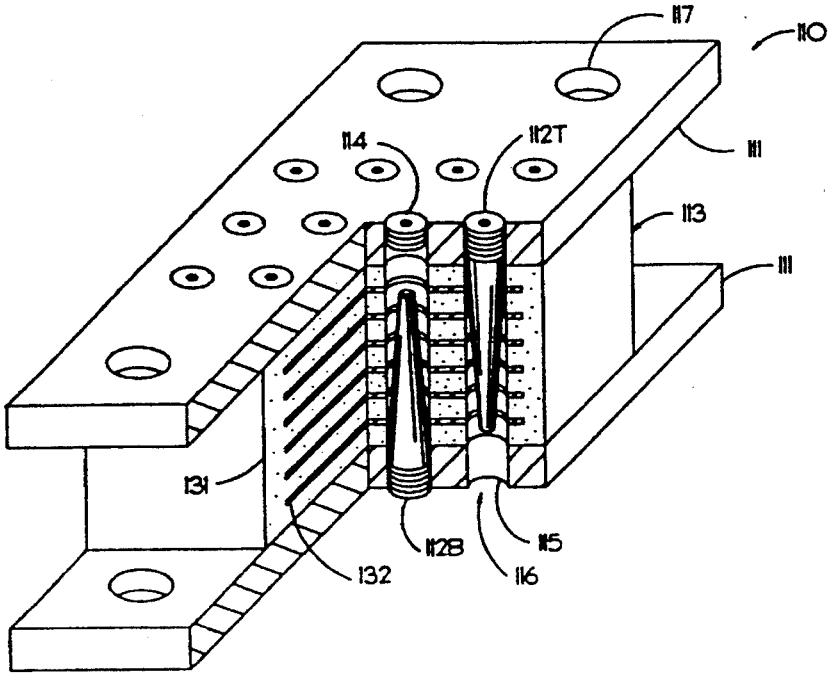
FIG. 9 illustrates a bearing with unexposed yielders.

FIG. 9 illustrates a bearing 110 with internal pins 112T (top) and 112B (bottom) pins located in through holes 116, which passes through load plates 111, and shim plates 132 embedded in rubber body 132. Hole 116 in plate 111 may be left smooth and open or may be threaded and plugged by threaded plug 114. Hole 116 in body 131 may be filled with silicon rubber or other elastomeric caulking material, not shown. Plate 111 has holes 117 for anchor bolting bearing 110 to the foundation and to the structure or machine, not shown.

The bearing is bolted between the structure or machine and its foundation. When the ground shakes with the foundation due to seismicity, the mass above the isolation bearings 10 or 110 remains relatively stationary due to its inertia. Thus, compared to structural deflections, a relatively wide vibratory shear movement will occur across the bearings. That movement slowly decays after the earthquake is over. The more energy is dissipated by the pin yielders 12 or 112 the sooner the motion will stop and the smaller the isolator movement will be. Seismic isolation (seismic force reduction) is achieved by the lateral softness of the rubber bearing body 13 or 131. That body provides motion decoupling and displacement restoring as well. Thus, the bearing returns to its original deformation state after earthquakes. Pins 112 with threaded base are replaceable without replacing bearing itself. Pins 12 are visually inspectable. Pins 12 are also serving as temporary press and tie to facilitate bearing assembly and handling before installation.

I claim:

1. An isolation bearing assembly, comprising:

an upper load plate having a first downwardly facing surface;

an oppositely disposed lower load plate having a second upwardly facing surface;

a reinforced rubber bearing body extending between and contacting said first and second surfaces;

a mid plate disposed approximately midway between and substantially parallel to said first and second surfaces and having a distal portion which extends radially beyond said body, said distal portion including a plurality of holes formed therein;

at least one first yield pin extending substantially orthogonally from said first surface, through a first one of said holes, and having a first distal end terminating between said first hole and said second surface;

at least one second yield pin extending substantially orthogonally from said second surface, through a second one of said holes, and having a second distal end terminating between said second hole and said first surface;

wherein, in response to an externally applied lateral force, said body is configured to resiliently deflect such that said first and second pins are engaged by said distal portion of said mid plate to thereby plastically deform said pins.

2. The assembly of claim 1, further comprising a plurality of said first and second yield pins extending from each of said first and second surfaces respectively, each of said first and second yield pins extending through one of said first and second holes respectively.

3. The bearing assembly of claim 2, wherein the number of said first yield pins extending from said first surface is equal to the number of said second yield pins extending from said second surface.

4. The bearing assembly of claim 1, wherein said bearing body is substantially cylindrical, and wherein said mid plate comprises a substantially flat, circular disk, and further wherein said distal portion of said mid plate comprises the outer perimeter of said mid plate.

5. The bearing assembly of claim 1, wherein said bearing body comprises a laminated stack of steel and rubber plates.

6. The assembly of claim 1 wherein said bearing body comprises an annulus extending between said first and second surfaces, said body comprising a plurality of laminated rubber and steel annular disks.

7. The assembly of claim 1, wherein each of said yield pins are tapered from the point of attachment to said load plate to said distal end.

8. The assembly of claim 1 wherein each of said yield pins is tapered along its length in accordance with a cube root function.

9. The assembly of claim 1 wherein each of said yield pins is configured to distribute yielding stresses throughout a substantial portion of the volume of said yield pin.

10. The assembly of claim 1, wherein each of said yield pins is tapered in accordance with a cube root profile such that forces applied to said yield pin by said mid plate result in substantially uniform yield stresses throughout the volume of said yield pin.

11. The assembly of claim 1, wherein said first and second distal ends of said first and second yield pins comprise a fastener configured to engage said mid plate at a maximum design lateral displacement of said bearing assembly.

12. The assembly of claim 1, wherein said bearing body is substantially rectangular.

13. The bearing assembly of claim 1, wherein said mid plate comprises two substantially similar, mating subplates, both rigidly secured together to form an integral structure.

14. The assembly of claim 1, wherein said bearing body comprises a laminated stack of steel and rubber plates, and wherein one of said rubber plates is at adjacent and vulcanized to one of said subplates, and an other one of said rubber plates is at adjacent and vulcanized to another one of said subplates subplate.

15. A seismic isolation bearing for bridges, buildings and machines comprising:

a steel reinforced rubber bearing body sandwiched between a first and second bearing load plates;

a plurality of exposed and tapered steel pin yields, fixed to each of said first and second bearing load plates; and a mid plate, embodied in said bearing body, said mid plate having a plurality of holes said yielders extending from said first and second bearing load plates and through said holes.

16. The bearing of claim 15 wherein said yielders comprise threaded pin ends.

17. The bearing of claim 16, further comprising locknuts configured to engage said threaded pin ends.

18. The bearing of claim 15, wherein said body includes a vertical, central through hole.

19. The bearing of 15 where said mid plate comprises two sub plates bolted together.

20. The bearing of claim 15, further comprising a rubber plate mounted to outside facing surface of one of said load plates.

* * * * *

UNITED STATES PATENT AND TRADEMARK OFFICE

CERTIFICATE OF CORRECTION

PATENT NO. : 5,490,356

DATED : February 13, 1996

INVENTOR(S) : Kemeny, Z.

It is certified that error appears in the above-indentified patent and that said Letters Patent is hereby corrected as shown below:

In claim 15, line 5, replace "yields" with --yielders--.

Signed and Sealed this

Fifteenth Day of April, 1997

*Attest:*

*Attesting Officer*

BRUCE LEHMAN

*Commissioner of Patents and Trademarks*